US009469948B2

(12) United States Patent
Landes

(10) Patent No.: US 9,469,948 B2
(45) Date of Patent: Oct. 18, 2016

(54) SELF RIGHTING MARKER POSTS

(71) Applicant: Scott D. Landes, Bloomington, MN (US)

(72) Inventor: Scott D. Landes, Bloomington, MN (US)

( * ) Notice: Subject to any disclaimer, the term of this patent is extended or adjusted under 35 U.S.C. 154(b) by 0 days.

(21) Appl. No.: 14/809,816

(22) Filed: Jul. 27, 2015

(65) Prior Publication Data

US 2016/0032544 A1 Feb. 4, 2016

Related U.S. Application Data

(63) Continuation of application No. 12/803,197, filed on Jun. 21, 2010, now abandoned.

(51) Int. Cl.
*E01F 9/011* (2006.01)

(52) U.S. Cl.
CPC ..... *E01F 9/629* (2016.02)

(58) Field of Classification Search
CPC ..... E01F 9/011; E01F 9/045; E01F 9/076; E01F 9/0175; E01F 9/0117; E01F 9/0111; E01F 13/028
USPC ..... 404/6, 9, 10
See application file for complete search history.

(56) References Cited

U.S. PATENT DOCUMENTS

| | | | | | |
|---|---|---|---|---|---|
| 1,465,642 | A * | 8/1923 | Keene | A47K 1/09 | 206/362.2 |
| 3,709,112 | A * | 1/1973 | Ebinger | E01F 9/0175 | 256/13.1 |
| 4,078,867 | A * | 3/1978 | Ronden | E01F 9/0175 | 404/10 |
| 4,290,585 | A * | 9/1981 | Glaesener | E01F 15/146 | 256/13.1 |
| 4,343,567 | A * | 8/1982 | Sarver | E01F 9/0175 | 116/209 |
| 4,522,530 | A * | 6/1985 | Arthur | E01F 9/0112 | 40/608 |
| 5,066,163 | A * | 11/1991 | Whitaker | E01F 9/0117 | 256/19 |
| 5,205,236 | A * | 4/1993 | Hughes | E01F 9/0175 | 116/209 |
| 5,452,965 | A * | 9/1995 | Hughes, Sr. | E01F 9/0111 | 404/10 |
| 5,620,277 | A * | 4/1997 | Cole, Sr. | E01F 9/0116 | 256/1 |
| 6,099,203 | A * | 8/2000 | Landes | E01F 9/0165 | 116/63 R |
| 7,025,016 | B1 * | 4/2006 | Landes | E01H 12/223 | 116/209 |

* cited by examiner

*Primary Examiner* — Abigail A Risic
(74) *Attorney, Agent, or Firm* — Jacobson and Johnson; Thomas N. Phung

(57) ABSTRACT

A hollow marker post and a resilient member located therein wherein the resilient member is statically dependent of the hollow marker post with the marker post and the resilient member dynamically dependent of each other to facilitate the return of the marker post to an upright condition when the marker post is impacted by an external force.

9 Claims, 3 Drawing Sheets

SELF RIGHTING MARKER POSTS

CROSS REFERENCE TO RELATED APPLICATIONS

This application is a continuation-in-part of my co-pending patent application Ser. No. 12/803,197; filed Jun. 21, 2010; titled SELF RIGHTING MARKER POST.

FIELD OF THE INVENTION

This invention relates generally to posts and, more specifically, to a self-righting marker post.

STATEMENT REGARDING FEDERALLY SPONSORED RESEARCH OR DEVELOPMENT

None

REFERENCE TO A MICROFICHE APPENDIX

None

BACKGROUND OF THE INVENTION

Typically, marker posts are supported either in or above the soil and have an upward extending member to alert the person to a potential hazard proximate the post. Some posts may either display information thereon while in other cases the mere presence of the post alerts a person to a hazardous or dangerous condition. Typically, the marker posts are made from a polymer plastic or other material capable of withstanding the elements for a period of years.

Landes U.S. Pat. No. 7,025,016 shows an example of a one-piece triangular shaped marker post having anchoring flaps to retain the marker post in the soil. One of the problems associated with marker posts is that oftentimes the marker posts are located in areas where the post may be subject to impacts from either animals or vehicles, which can cause the post to bend. The impact can cause the marker post to lose its ability to return to the normal upright condition.

Landes U.S. Pat. No. 6,099,223 shows an example of a marker post, which can return to its original shape through the use a triangular shaped resilient post that includes corner webs, which facilitate the restoring of the marker post to an upright condition when the post is bent by an impact.

U.S. Pat. No. 4,571,118 shows an example of a tubular shaped marker post, which also facilitates the restoring of the marker post to an upright condition when the post is bent by an impact. While the Landes U.S. Pat. No. 6,099,223 discloses the use of corner webs to facilitate the restoring of the marker post to an upright condition the U.S. Pat. No. 4,571,118 uses a simulated tubular shaped marker post having a stiff concentrically positioned resilient rod which supports a plurality of thin walled bulbs in an end-to-end condition along the exterior of the rod. The ends of each of thin walled bulbs form a tight fit with the concentrically positioned resilient rod so that when the bulbs are impacted by an object the compression of air within the bulbs prevents a sharp impact between the colliding object and the rod. The U.S. Pat. No. 4,571,118 points out that by preventing fracturing contact between the rod and the impacting object the rod can return to its straight orientation. A hole in each of the thin walled bulbs allows a gradual ingress of air into the interior of the bulbs allowing the bulbs to return to their original shape.

U.S. Pat. No. 4,611,949 shows another type of marker device wherein the marker post is supported by a detachable base with the detachable base being able to support and stabilize the simulated tubular shape markers shown in U.S. Pat. No. 4,571,118.

Although there are existing marker posts that can return to an original upright condition when impacted the formation of a marker post with internal webs can be difficult and costly to make. Similarly, the formation of a simulated tubular post with thin walled bulbs, which are supported in an end-to-end condition on a central support rod, can also be costly to make as well as providing less space for visual information. In addition some marker posts may fail to return to the upright condition when subjected to repeated impacts.

SUMMARY OF THE INVENTION

Briefly, the invention comprises a self-righting two-part marker post comprising an outer resilient hollow member which is supported in an upright condition and an interior resilient member located therein with the interior resilient member laterally supported in a statically dependent condition within the outer resilient hollow member. The interior resilient member and the outer resilient hollow member are at least partially coextensive so as to create a dynamic dependency between the outer resilient hollow member and the interior resilient member when the outer resilient hollow member is bent to thereby facilitate restoring forces to return of the two-part marker post to an upright condition.

DESCRIPTION OF THE PREFERRED EMBODIMENT

Figure 1:
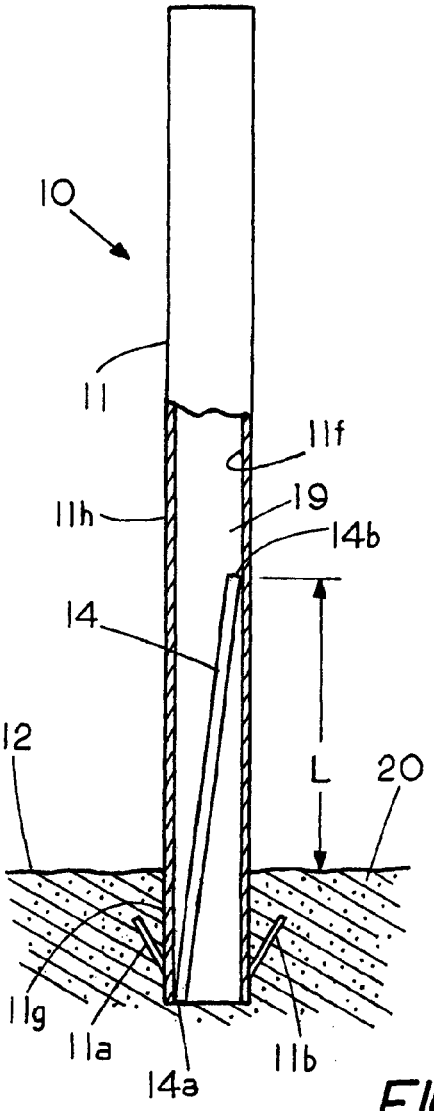
FIG. 1 is a cross sectional view of a two-part marker post with a resilient member located therein.
Figure 1A:
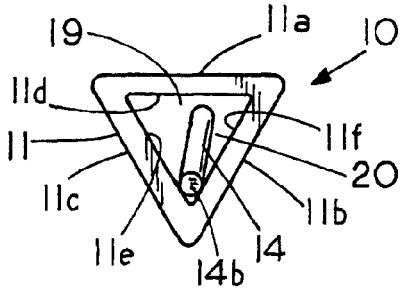
FIG. 1A shows a top view of the two-part marker post of FIG. 1.

FIG. 1 and FIG. 1A show a two-part self righting marker post 10 comprising an elongated hollow resilient member 11 having a triangular cross sectional shape with member 11 having a set of three exterior faces 11*a*, 11*b* and 11*c* for displaying information and a set of three interior faces 11*d*, 11*e* and 11*f* forming an elongated hollow interior space 19. An elongated resilient member 14 is located in the interior space 19. Member 11 has a first end 11*g* embedded in a supporting soil 20 to form a support to hold member 11 in an upright condition with an opposite end 11*h* extending above a top soil line 12 of supporting soil 20 for providing visual information to those persons proximate the post 10.

Figure 2:
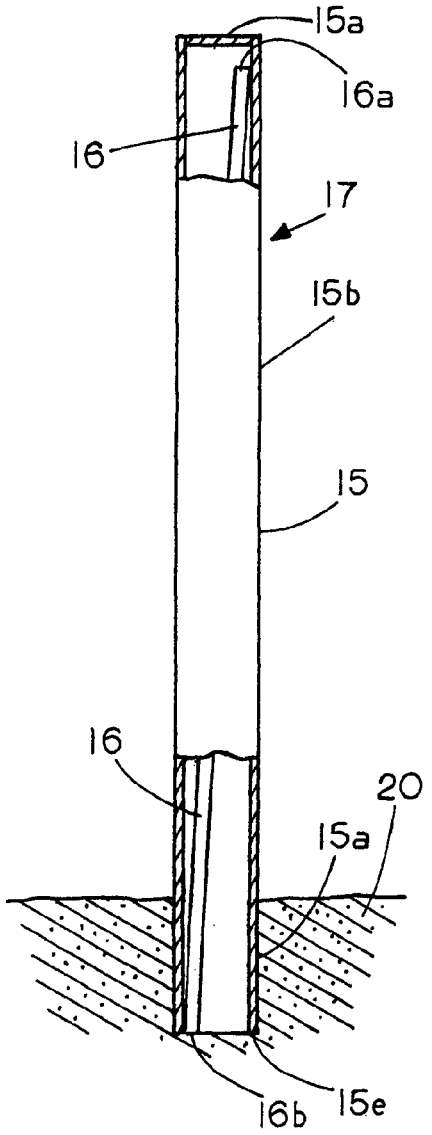
FIG. 2 is a cross sectional view of a second marker post with a longer resilient member located therein.

FIG. 1 shows elongated resilient member 14 located in an askew condition with respect to member 11 while being gravitationally held in an upright condition within the hollow 19 of member 11 by the interior surfaces of member 14. That is, a lateral spacing of an exterior surface of the resilient member 14 to an interior surface of the hollow resilient member 19 varies as a function of the vertical location of the exterior surface of the resilient member with respect to the interior face of the hollow resilient member since the rod 14 rests at an angle therein as the lower portion of resilient member 14 is free from laterally support from soil 20. Similarly, FIG. 2 shows a two-part marker post 17 with an identical but longer elongated resilient member 16 located in an askew condition with respect to member 15, which has an outer surface 15*b* for attaching visual information thereto. An integral cap 15*a* covers the end of member 15 to keep rain and debris from accumulating in post 17.

FIG. 1 and FIG. 1A show resilient member 14 is laterally held in an upright condition by the internal sidewalls or surface of member 15. In the example shown the resilient member 14, while gravitationally held in the bottom portion of hollow member 11, is axially displaceable with respect to hollow member 11 and similarly FIG. 2 shows resilient member 16, while gravitationally held in the bottom portion of hollow member 15, is axially displaceable with respect to hollow member 15 since hollow member 15 only provides lateral support for the resilient member located therein. In the example shown the end 16*b* of resilient member 16 and the end 15*e* of elongated resilient member 15 are both resting in a substantially coplanar condition on the bottom of the hole in soil 20.

A typical use of the marker post 10 is to provide visual information about hazardous materials or items in the vicinity of the marker post. Unfortunately, the marker post is often located in areas where the post is subject to impacts, for example impact from animals or vehicles. To overcome the effects of the impacts the marker post may be made from a resilient material which provides an integral restoring force to bring the marker post to its normal upright condition after being bent due to external forces. Unfortunately, the resiliency of the materials which are suitable for marker posts, i.e. polymer plastics are oftentimes characterized by lacking sufficient resiliency to continue to bring the marker post back to its original upright condition, especially when the marker post is repeatedly bent up to 90 degrees or more by impacts from either vehicles or animals. One of the ways to overcome the inability of a marker post to return an upright condition is shown in my U.S. Pat. No. 6,099,203 which incorporates integral webs in each of the corners of a marker post to enhanced the ability of the marker post to return to the upright condition when the marker post is subject to impacts that bend the marker post. The invention disclosed herein also enhances the ability of a marker post to return to the upright condition while eliminating the need to incorporated integral webs into each of the corners of the post.

The two-part self-righting marker post described herein has been found to return to an upright condition even after repeated bending of the two-part marker post thus making it suitable for placement in wildlife areas where the two-part marker post may be repeatedly bent by contact with herds of wildlife. In addition, the two-part marker post has been found to retain its memory for an extended period of time, consequently even if a vehicle inadvertently parks on the two-part marker post for a period of hours once the vehicle is moved off the two-part marker post the two-part marker post has been found return to an upright condition.

FIG. 1 shows the hollow elongated hollow resilient member 11 located in an upright condition with a lower end of the hollow resilient member 11 supported by compaction of a supporting soil 20 around the lower end 11*g* of member 11. If desired integral flaps 11*a* and 11*b* may be formed in the end of member 11 to provide resistance to removing member 11 from the soil. Located within the hollow member 11 is the resilient member or rod 14 of length L having a first end 14*a* resting on top of soil 20 and a second end 14*b* resting laterally against an interior face 11*f* of member 11 to thereby maintain the resilient member 14 in a general upright but askew condition within an interior space 19 of marker post 10. As can be seen in FIG. 1 the lateral static support of resilient member 14 in an upright condition is dependent on the resilient member 14 being positioned in the interior hollow 19 of the upright marker post 10. FIG. 1 shows the lower end 14*a* of resilient member 14 is substantially coplanar with the lower end of hollow resilient member 11 with both the lower end 14*a* of resilient member 14 and the lower end 11*g* of hollow resilient member 11 located below a top soil line 12 and the upper end of hollow resilient member 11 and the upper end of resilient member 14 located above the top soil line 12.

FIG. 1 and FIG. 1A show that extending vertically within the elongated interior space 19 of elongated hollow resilient member 11 is the elongated cylindrical resilient rod 14. Resilient rod 14 is held in an upright condition by having a lower end 14*a* supported on soil 20 while the opposite end 14*b* of the resilient rod 14 is laterally supported by an interior sidewall 11*f* of resilient member 11. In the example shown the resilient rod 14 is maintained in the static and upright condition solely through lateral support from the inner set of faces 11*c*, 11*f* or 11*d* of the elongated hollow resilient member 11. In the condition shown the resilient member 14 is statically dependent on the elongated hollow resilient member 11 to maintain the resilient member 14 in an upright condition although the resilient member 14 may take any of a number of different upright positions within elongated hollow resilient member 11.

FIG. 1A shows the elongated hollow resilient member 11 and the cylindrical resilient member 14 each have a different cross sectional shape with the cylindrical resilient member normally held in an upright condition by an interior face 11*d*, 11*e*, 11*f* of the elongated hollow resilient member 11. While the marker post is shown as having a triangular cross sectional shape it is understood that one may use marker posts of different cross sectional shapes without departing from the spirit and scope of the invention described herein.

FIG. 1A shows lateral contact between an upper end 14*b* of the resilient rod 14 and an interior face 11*f* of the hollow resilient member 11. A radial air gap is shown between the upper portion of rod 14 and the interior faces 11*e* and 11*f* of member 11. The diameter of the cylindrical resilient member 14 is less than the distance between interior surfaces of member 14 to allow the rod to sit freely therein. In the upright condition the loose fit between the rod 14 and the resilient member 11 creates an air gap between the resilient rod and the lateral faces except in the end portions of the rod 14 which contact the interior faces of the hollow resilient member 11. The relative disparity between the external diameter of the rod 14 and the larger hollow 19 allows one to easily position rod 14 within the hollow 19 of marker post 10.

The resilient rod 14 is characterized by having sufficient resiliency to return to an original condition even when bent at angle of up 90 degrees or more. While various materials may be used for the resilient rod a suitable material for resilient rod 14 is fiberglass since it has the ability to bend up to 90 degrees or more without breaking and has sufficient memory to continue return to its original straight condition even after repeated bending thereof. By positioning of the resilient rod 14 within the elongated hollow resilient member 11 the resilient rod 14 becomes statically dependent on outer member 11, however, both are dynamically dependent on each other when both are bent.

As pointed out above suitable materials for resilient member 14 include fiberglass as well as other materials. In one example a solid fiberglass rod having a diameter of ⅜ inch was placed in the hollow interior of a triangular shaped polypropylene member 11 having an outside dimension of approximately 3 inches to provide the dynamic interaction between the interior resilient member 14 and the exterior elongated hollow resilient member 11. The size of the post and the rod are given for illustrative purpose and no limitation thereto is intended. While the rod is shown as having a circular cross section shape and the member 11 is shown as having a triangular cross sectional shape it is envisioned that other cross sectional shapes may be used for either the elongated hollow resilient member or the resilient member 14 without departing from the spirit and scope of the invention described herein. Similarly, although resilient member 14 is shown as a solid, member 14 may be hollow without departing from the spirit and scope of the invention.

FIG. 1 shows a cross sectional view where the resilient rod 14 extends partially upward in marker post 10 and FIG. 2 shows a partial cross sectional view having a resilient rod 16 that extends substantially the length of the marker post 17. In the example of FIG. 2 the soil 20 supports the marker post 17 in an upright condition while the lower end of resilient member 16 is substantially coplanar with the lower end of marker post 17. In each case the resilient rods, which are located in the hollow of the elongated hollow resilient member, extend past a portion of the marker post which bends when the post is impacted, for example by an animal or vehicle. In most instances the portion of the post that is subject to bending is the portion of the marker post proximate the base of the marker post since the base resists movement or deflection of the lower end of the post. To obtain the benefit of the two-part snap-back marker post described herein does not require that the resilient rod be attached or secured to the post nor does it require that the resilient member be maintained in a concentric position with respect to the marker post. That is, to obtain the benefits of the invention described herein the gravitationally holding of the elongated resilient rod in the elongated hollow space of the marker post has been found to enhance the ability of the marker post to return to the upright condition by allowing the resilient rod to apply an internal restoring force to the marker post which coacts with the normal inherent marker post restoring forces to more quickly restore the marker post to the upright condition then if the marker post did not have the internal resilient rod therein.

A further benefit obtained with the invention described herein is that the use of a resilient member within the marker post lengthens the life of the marker post even though the external hollow member 11 may have become weakened from repeated impacts. That is although hollow member 11 may have become weakened by repeated impacts the resilient member 14 within the hollow member 11 remains as a restoring force, which has been found to extend the life of the marker post 10. It has been found that an elongated hollow member 11, without an internal resilient member, begins to fatigue and may not be able to return the marker post 10 to the upright condition thus shortening the life of the marker post. In contrast, it has been found that the life of a marker post having an internal resilient member 14 and a hollow external member 11 can have a substantially longer life than a hollow external member without an internal resilient member.

FIG. 2 shows the two-part marker post 17 in an upright static condition. In the static condition the elongated resilient member 16, rests in a substantially upright position on the interior faces of the hollow elongated member 15. However, in the dynamic condition i.e. where both the elongated resilient member 16 and the resilient member 15 are generating restoring forces, the member 16 and member 15 coact with each other to restore the marker post to an upright condition as described hereinafter.

Figure 2A:
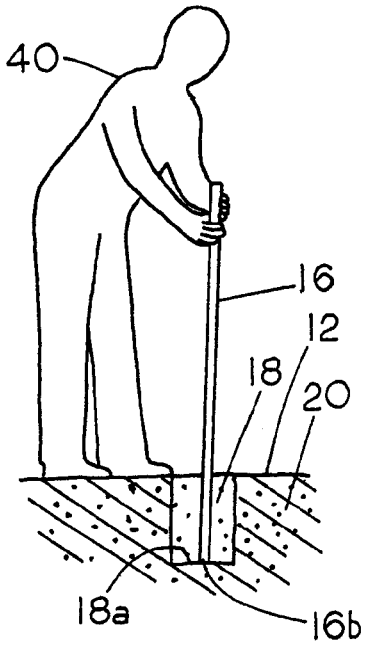
FIG. 2A shows an operator placing a resilient member in a hole in the soil.
Figure 3:
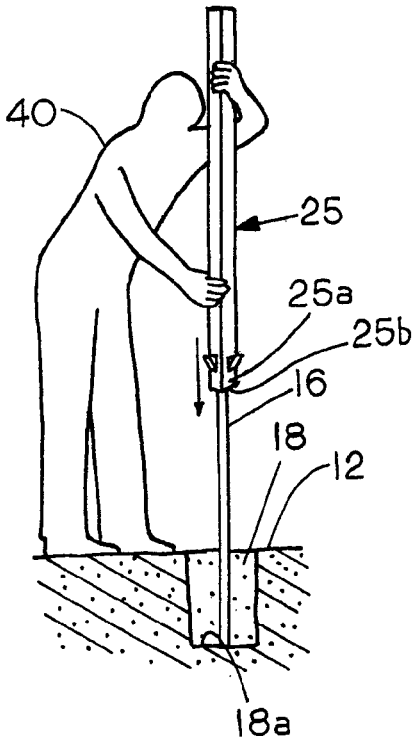
FIG. 3 shows an operator placing a marker post around the resilient member.
Figure 4:
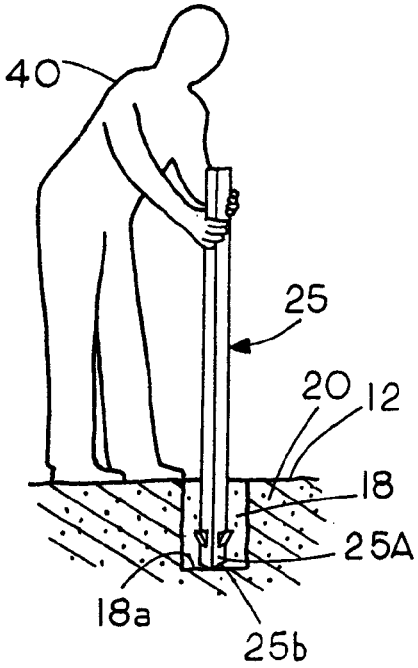
FIG. 4 shows the operator lowering the hollow resilient member into the hole in the soil.

FIG. 2A, FIG. 3 and FIG. 4 illustrate the method of mounting the self-righting marker post 25 using the cylindrical resilient rod 16 as an internal support. In the first step a hole 18 is formed in soil 20. FIG. 2A shows an operator 40 placing the cylindrical rod 16 in an upright condition with the end 16*b* of rod 16 in contact with the soil layer 18*a* at the bottom of the hole 18.

Figure 6:
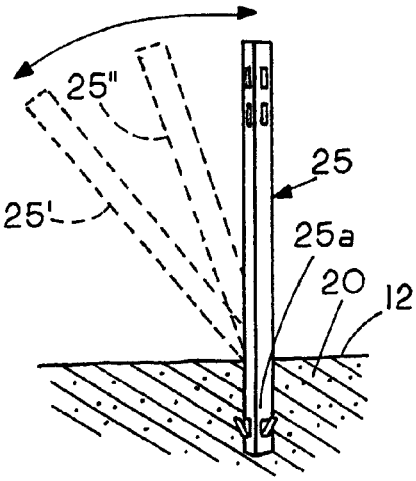
FIG. 6 shows the marker post returning to its upright condition with the assistance of the internal resilient member.

FIG. 3 illustrates the next step in installing a marker post where an end 25*a* of the hollow triangular shaped marked post 25 is placed around rod 16 and the post is lowered into the hole 18 with the rod 16 located in the interior hollow of maker post 25. FIG. 4 shows the maker post 25 extended into hole 18 with the lower end 25*b* of marker post 25 in contact with the soil layer 18*a* in the bottom of hole 18. In this condition end 25*b* of post 25 is located below the topsoil line 12. The marker post is now in a condition wherein soil 20 can be compacted around end 25*a* to enable soil 20 to form an end support to hold the marker post 25 in the upright condition as illustrated in FIG. 6.

In the method of mounting the marker post the operator gravitationally secures the resilient rod 16 within the interior of the hollow triangular shaped post 25 by placing the post 26 around resilient rod 16 and allowing the marker post 25 to fall down to the bottom of hole 18 in soil 20. In the example shown in FIG. 4 the resilient rod 16 and the marker post 25 are both in an upright condition with post 25 about to be supported in an upright condition by placement of soil 20 around the lower end of the marker post 25. It is envisioned that other methods of supporting the lower end the marker post 25 may be used. For example, materials such as concrete may be used to form the support as well as other structures without departing from the spirit and scope of the invention described herein.

As noted resilient rod 16 is shown located in an upright condition but is dependent for lateral support from marker post 25, which comprises an elongated hollow resilient member. While FIG. 2 shows resilient rod 16 supported in an upright condition by marker post 17 in some cases one may wish to support the resilient rod 16 in an upright condition by supporting the lower end 16*b* of the resilient rod 16 in the soil 20 without departing from the spirit and scope of the invention. In this condition both the rod 16 and the marker post 17 may be in an upright condition although the ability of the marker post to return to the upright condition has been found to somewhat diminished by using a support to secure both the end of the resilient rod 16 and the marker post 25 in an upright condition.

Figure 5:
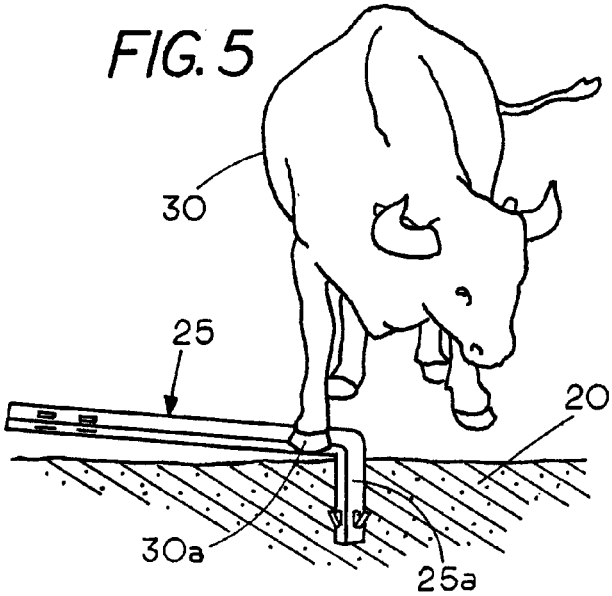
FIG. 5 shows an animal bending the marker post of FIG. 4 by stepping on the marker post.

To illustrate how a two-part marker post may be impacted by an animal FIG. 5 shows a bull 30 with its hoof 30*a* on the marker post 25. Typically, animals may use the marker posts as a scratching posts and in doing so they can bend the post over and then step on the side of the post which can bend a normal vertical orientated or upright post 25 to the horizontal condition illustrated in FIG. 5. Similarly, a post may be bent by a vehicle that drives over the posts as well as by other objects or persons.

Figure 5A:
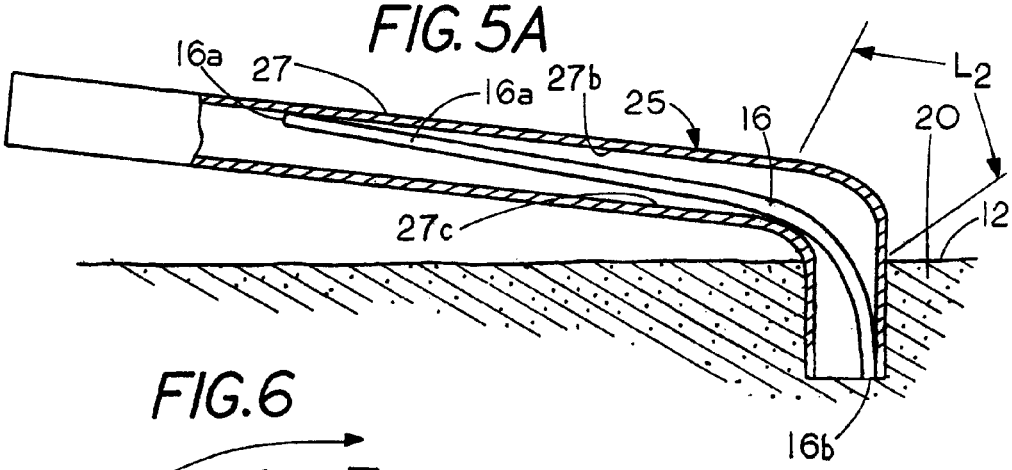
FIG. 5A is a cross section view of the marker post in the bent condition showing the resilient member in a bent condition.

To illustrate the dynamic dependency or dynamic interaction of the two-part marker post 25 reference should be made to FIG. 5A which shows a cross sectional view of the two-part marker post 25 with both the outer elongated hollow member 27 and the resilient interior member or rod 16 in a bent condition. As can be seen in FIG. 5A the top end 16*a* of resilient member 16 engages an interior face 27*b* of the outer hollow member 27 while the lower end 16*b* of resilient member 16 rests on soil 12 as it engages interior face 27*b*. An intermediate portion of member 16 engages an opposite face 27*c* located at a bend in marker post 25. The bending of member 16 generates an internal separate restoring force for the two-part marker post 25. A feature of the two-part self righting marker post 25 of the invention described herein is that the two-part marker post 25 will snap-back or return to its original upright condition through the coaction of the internal resilient member 16 and the outer resilient member 27 when the resilient member 16 and the resilient member 27 are coextensive with each other in the portion of the marker post which may be subject to bending. The bend of the marker post 25 which is designated by $L_2$, may vary with the size and shape of the post, but the bend in the maker post generally occurs in the post region proximate the support for the marker post since the support resists movement or bending of the post. In this case the soil 20 maintains the lower portion of the post 25 in an upright condition while a force or impact on the upper portion of the marker post 25 causes the marker post 25 to bend above or at the top soil line 12. As shown in FIG. 5A when bent the internal resilient member 16 extends both above and below the bend $L_2$ in the marker post to generate a restoring force distinct from the inherent restoring force of resilient member 27.

A reference to FIG. 6 shows the marker post 25 in both solid and dashed lines to indicate how the marker post 25 returns to the upright condition. Reference numeral 25' and 25" show the marker posts as it returns to the upright condition from the bent condition illustrated in FIG. 5 while reference numeral 25 identifies the marker post returned to the upright condition.

While marker post 25 is shown having a triangular cross sectional shape with equal length sides other triangular configurations may be used as well as other shapes having a hollow interior space without departing from the spirit and the scope of the invention described herein.

Thus with the combination of a resilient member located in the hollow of an elongated hollow member the dynamic coaction of the internal resilient member with the interior faces of the outer hollow resilient member assists in causing the two-part self righting marker post to snap-back to an original upright condition even though the internal resilient member may be gravitationally held in position within marker post 25 as well as being statically dependent on the outer resilient member 17 for maintaining the internal resilient member in a condition for assisting in restoring of the marker post 25 to an upright condition.

I claim:

1. A two-part snap-back marker post comprising:

an elongated hollow resilient member having a triangular cross section having a set of three exterior faces for displaying information and a set of three interior faces forming a triangular-shaped hollow interior, said elongated hollow resilient member having a first end for embedding in a support surface and a second end for extending above the support surface with the second end subject to impact from animals or vehicles, said elongated hollow resilient member lacking sufficient resiliency to return to an original upright condition when repeatedly bent up to 90 degrees or more; and a solid cylindrical freestanding resilient member having a cross sectional diameter that is less than one half the length of an altitude of said triangular cross section of said elongated hollow resilient member, said solid cylindrical freestanding resilient member having a first end for positioning below a top soil line together with an end of the elongated hollow resilient member, said first end of said solid cylindrical freestanding resilient member detached from said elongated hollow resilient member and directly engaging a soil surface, said solid cylindrical freestanding resilient member having a second end, said second end of the cylindrical resilient member and the second end of the elongated hollow resilient member each resting in a substantially coplanar condition on top a soil layer located below the top soil line and the second end of the elongated hollow resilient member having a portion extending above the top soil line, said second end of said solid cylindrical freestanding resilient member laterally supported by said elongated hollow resilient member by directly resting laterally against one of said interior faces of said elongated hollow resilient member while being gravitationally held in the hollow interior of said elongated hollow resilient member, said cylindrical resilient member characterized by having sufficient resiliency to return to an original condition even when repeatedly bent up to 90 degrees or more to thereby create a dynamic coaction between the cylindrical resilient member and the elongated hollow resilient member in response to a simultaneously bending of said elongated hollow resilient member and said cylindrical resilient member to thereby cause the elongated hollow resilient member with the assistance of the cylindrical resilient member to return to an original upright condition after being bent.

2. The two-part snap-back marker post of claim 1 wherein the length of the solid cylindrical freestanding resilient member is less than half the length of the elongated hollow resilient member and the cylindrical resilient member is located in an askew condition with respect to the elongated hollow resilient member when the hollow resilient member is an upright condition.

3. The two-part snap-back marker post of claim 2 wherein the elongated hollow resilient member comprises a polypropylene elongated hollow resilient member.

4. The two-part snap-back marker post of claim 3 wherein the solid cylindrical freestanding resilient member comprises a one-piece fiberglass rod.

5. The two-part snap-back marker post of claim 4 wherein the solid cylindrical freestanding resilient member is axially displaceable with respect to the elongated hollow resilient member.

6. The two-part snap-back marker post of claim 5 wherein the solid cylindrical freestanding resilient member comprises a cross sectional diameter that is less than one fourth of the length of an altitude of said triangular cross section of said elongated hollow resilient member.

7. The two part snap-back marker post of claim 1 wherein the two-part snap-back marker post consists of the elongated hollow resilient member and the solid cylindrical freestanding resilient member with the end of the solid cylindrical freestanding resilient member laterally and vertically displaceable within the elongated hollow resilient member.

8. The two-part snap-back marker post of claim 1 wherein the elongated hollow resilient member includes anchoring flaps located proximal the first end of the elongated hollow resilient member to assist in retaining the elongated hollow resilient member in the support surface, said anchoring flaps preventing the need to at least partially fill the interior of said embedded elongated hollow resilient member with bulk materials to assist in retaining the elongated hollow resilient member in the support surface.

9. A two-part snap-back marker post comprising:

an elongated hollow resilient member having an equilateral triangular cross section having a set of three exterior faces for displaying information and a set of three interior faces forming a triangular-shaped hollow interior, said elongated hollow resilient member having a first end for embedding in a support surface and a second end for extending above the support surface with the second end subject to impact from animals or vehicles, said elongated hollow resilient member lacking sufficient resiliency to return to an original upright condition when repeatedly bent up to 90 degrees or more; and a solid cylindrical freestanding resilient member having a cross sectional diameter that is less than one fourth the length of an altitude of said triangular cross section of said elongated hollow resilient member, and a length of less than half a length of said elongated hollow resilient member, said solid cylindrical freestanding resilient member having a first end for positioning below a top soil line together with an end of the elongated hollow resilient member, said first end of said solid cylindrical freestanding resilient member detached from said elongated hollow resilient member and directly engaging a soil surface, said solid cylindrical freestanding resilient member having a second end, said second end of the cylindrical resilient member and the second end of the elongated hollow resilient member each resting in a substantially coplanar condition on top a soil layer located below the top soil line and the second end of the elongated hollow resilient member having a portion extending above the top soil line, said second end of said solid cylindrical freestanding resilient member laterally supported by said elongated hollow resilient member by directly resting laterally against one of said interior faces of said elongated hollow resilient member while being gravitationally held in the hollow interior of said elongated hollow resilient member, said cylindrical resilient member characterized by having sufficient resiliency to return to an original condition even when repeatedly bent up to 90 degrees or more to thereby create a dynamic coaction between the cylindrical resilient member and the elongated hollow resilient member in response to a simultaneously bending of said elongated hollow resilient member and said cylindrical resilient member to thereby cause the elongated hollow resilient member with the assistance of the cylindrical resilient member to return to an original upright condition after being bent.

* * * * *